US007589644B2

(12) United States Patent
Meunier

(10) Patent No.: US 7,589,644 B2
(45) Date of Patent: Sep. 15, 2009

(54) METHOD AND ONBOARD DEVICE TO ASSIST RUNNING IN AN AIRPORT

(75) Inventor: Hugues Meunier, Frouzins (FR)

(73) Assignee: Thales, Neuilly sur Seine (FR)

( * ) Notice: Subject to any disclaimer, the term of this patent is extended or adjusted under 35 U.S.C. 154(b) by 306 days.

(21) Appl. No.: 11/529,313

(22) Filed: Sep. 29, 2006

(65) Prior Publication Data

US 2007/0078590 A1 Apr. 5, 2007

(30) Foreign Application Priority Data

Sep. 30, 2005 (FR) ..... 05 10017

(51) Int. Cl.
*G08B 21/00* (2006.01)

(52) U.S. Cl. ..... 340/945; 340/933; 340/948; 340/951; 340/953; 340/972; 342/29; 342/36

(58) Field of Classification Search ..... 340/945, 340/933, 951, 953, 948, 961, 972, 988; 342/29, 342/36

See application file for complete search history.

(56) References Cited

U.S. PATENT DOCUMENTS 5,530,440 A * 6/1996 Danzer et al. ..... 340/933
6,064,319 A * 5/2000 Matta ..... 340/917
6,144,915 A 11/2000 Shiomi et al.
6,392,692 B1 * 5/2002 Monroe ..... 348/143
6,462,697 B1 * 10/2002 Klamer et al. ..... 342/36
6,606,563 B2 8/2003 Corcoran, III
6,927,701 B2 * 8/2005 Schmidt et al. ..... 340/959
7,414,545 B2 * 8/2008 Vickas ..... 340/953
2002/0109625 A1 * 8/2002 Gouvary ..... 342/29
2003/0009278 A1 1/2003 Mallet et al.
2006/0167598 A1 * 7/2006 Pennarola ..... 701/11

FOREIGN PATENT DOCUMENTS

WO 03/107299 12/2003

* cited by examiner

*Primary Examiner*—Davetta W Goins
(74) *Attorney, Agent, or Firm*—Lowe Hauptman Ham & Berner, LLP

(57) ABSTRACT

The invention relates to a method to help a person responsible for a vehicle on an airport to follow running procedures in the airport, the vehicle including a device for using the method, including: a database including: data modelling all or some of an airport environment; one or several acquisition devices for acquiring procedures applicable to the running operation on the airport; one or several devices configured to acquire and determine vehicle status information; calculation means using the database; graphic transcription means and warning means; means of generating sound and visual alarms; wherein the assistance method includes at least the following steps: determine applicable procedures; continuously calculate deviations between the behaviour of the vehicle and applicable procedures; graphic transcription of progress of the vehicle while running and deviations from applicable procedures; trigger visual and/or sound alerts when a predetermined deviation threshold is crossed.

29 Claims, 4 Drawing Sheets

METHOD AND ONBOARD DEVICE TO ASSIST RUNNING IN AN AIRPORT

RELATED APPLICATION

The present application is based on, and claims priority from, France Application Number 05 10017, filed Sep. 30, 2005, the disclosure of which is hereby incorporated by reference herein in its entirety.

FIELD OF THE INVENTION

The method and device according to this invention help a person responsible for a vehicle on an airport (ground vehicle, aircraft) to follow running procedures assigned to him, either explicitly (oral instructions or through datalink) or implicitly (regulations, previous instructions), and it also helps to monitor that these procedures are actually respected.

Information and warnings are generated if procedures are followed correctly, and/or if it is probable or certain that they will soon no longer be respected.

BACKGROUND OF THE INVENTION

Since TAWSs <<Terrain Avoidance Warning Systems)<< have significantly reduced CFITs (Controlled Flight Into Terrain) type accidents in recent years, the main cause of aircraft accidents is now collisions on the ground between aircraft and other aircraft or ground vehicles moving on the same airport.

The main reason is the penetration of a vehicle onto a traffic way (runway, taxiway, parking area) within the area of an airport without prior authorization to enter this area, and is normally referred to as "Runway Incursion" or "Runway Intrusion". Such unauthorized penetrations inevitably introduce risks of collisions with any aircraft moving on these traffic ways (either during take off or landing).

These risks are mainly related to a failure to respect running authorizations (largely due to inattention), given by air traffic control or airport traffic control authorities.

Note that a "Runway Incursion" refers to unauthorized penetration on a traffic way and "Runway. Intrusion" refers to unauthorised penetration on a traffic way already occupied by another moving vehicle or aircraft.

The continuous increase in air traffic and the complexity of airports increases these risks of intrusion, and consequently increases the risks of collision between aircraft and other moving vehicles.

According to rules in force at the moment, a vehicle on an airport moves at the request of the person responsible for the vehicle, but in accordance with authorizations provided by air traffic control or airport traffic control authorities responsible for assuring organised and safe flow of movements on the ground. The person responsible for the vehicle assures that it runs freely in accordance with the authorisations obtained.

Up to now, the corresponding positions of the different vehicles and the corresponding authorisations were monitored visually by air traffic control or airport traffic control authorities, very often using monitoring systems mostly based on surveillance radar on the ground within the airport, and recently also possibly by multi-lateration ground systems (using data output by onboard transponders).

Based on position information supplied by these systems, air traffic control or airport traffic control authorities generate running authorisations for the different vehicles along a route as far as a transfer point at which the vehicle must wait until it obtains a new authorisation before starting a new movement.

Running authorizations and their characteristics (routing, compulsory transfer point) are supplied very largely by voice (typically through a VHF channel) and are taken into account mentally by the person responsible for the vehicle, and are rarely inserted into onboard systems.

Recently, on some airports and with some airlines, it has become possible to supply these instructions through CPDLC (Controller-Pilot Data Link Communications) in a form such as PDC (PreDeparture Clearances) through a Datalink (VHF data channel). The instructions are then displayed on an onboard screen (or possibly printed onboard), but they are usually not inserted into other onboard systems.

In this case such an insertion could be envisaged automatically, or in both cases it could be done manually by the person responsible for the vehicle, possibly but not necessarily using predefined routing lists.

Transfer points are systematically given for crossing "taxiway holding position" (also called "Stop-bars" or "Holding points"), or also "taxiway intersection marking" as defined in Appendix 14 in the ICAO. Control authorities may also use other transfer points.

Since the person responsible for the vehicle is fully responsible for running as far as the transfer point, failure to respect the transfer point or the assigned routing (mainly by inattention) can introduce the above-mentioned risks of a Runway Incursion or a Runway Intrusion.

Up to now, there has been no available onboard system to help the pilot in following the assigned touting and particularly to notify him if he passes a compulsory transfer point that may or may not have been assigned to him (for example following a routing error). Such functions are only carried out at the ground control level.

Therefore, it is very important to provide the person responsible for the vehicle with information to assist him in his functions.

American patent U.S. Pat. No. 6,606,563 describes a warning system (sound only) notifying the pilot of an aircraft when the distance from his aircraft to a runway or more generally any zone is less than a predefined value.

Even if the system described apparently provides progress to notify the pilot when he is approaching a runway, it does not help the pilot in following the assigned route and any warnings that it gives are not related to compulsory transfer points that were assigned by their air control or airport traffic control authorities.

The invention described in the following is intended to provide a solution to significantly reduce these risks of "Runway Incursion" or "Runway Intrusion" by helping with following running instructions assigned to the vehicle, and/or by monitoring that these running instructions are respected.

SUMMARY OF THE INVENTION

To achieve this, the invention proposes a method of providing assistance to the person responsible for an airport vehicle in following running procedures in the airport, the vehicle including a device for using the method, including:

- a database (10) including:
  - data modelling all or some of an airport environment (20);
  - data modelling the characteristics of the vehicle (22) such as the dimensions, weight, mobility characteristics, etc.;
  - predefined running procedures on the airport (24);
- at least one status of the vehicle device (26) configured to acquire and determine vehicle status information;

at least one procedures device (29) configured to acquire procedures supplied by the person responsible for the vehicle or the airport supervisor;

an acquisition device (45) configured to acquire information complementary to the data modelling the airport or updates to some of these data;

calculation means (28) using the database and its updates;

graphic transcription means (30);

means of generating sound and visual alarms (32);

characterised in that it comprises at least the following steps:

determine procedures applicable to the vehicle among acquired procedures and predefined procedures;

continuously calculate deviations between the behaviour of the vehicle and applicable procedures;

graphic transcription of progress of the vehicle while running and deviations from applicable procedures;

trigger visual and/or sound alerts when a predetermined deviation threshold is crossed.

The invention also describes an onboard device for implementation of the method for helping the person responsible for an airport vehicle in following running procedures in the airport, the vehicle including a device for use of the method, including:

a database including:

data modelling all or some of an airport environment, data modelling characteristics of the vehicle, such as the dimensions, weight, mobility characteristics, etc.

predefined running procedures on the airport, at least one vehicle status device (26) configured to acquire and determine status information of the vehicle;

at least one procedures device (29) configured to acquire procedures supplied by the person responsible for the vehicle or the airport supervisor;

an acquisition device (45) configured to acquire information complementary to the data modelling the airport or updates to some of these data;

calculation means (28) using the database and its updates;

means of graphic transcription of progress of the vehicle while running and deviations from applicable procedures;

means of generating sound and visual alarms.

The graphic transcription means comprise an onboard screen on which all or some of the elements of the airport environment are displayed making use of data contained in the database and warning information in graphic and/or text form;

The processing and calculation means enable access to data, update these data, generate the display of the airport environment to be displayed and determine any information and/or warnings to be displayed.

In particular, the status of the vehicle is defined by its position and possibly its direction and/or its speed perceived by sensors built into this vehicle or received by external signals and is made available for use.

The database describes all or some elements (particularly as defined in document Eurocae ED 99—parking areas, taxiways, runways, stop bars, etc.) of an airport environment.

Information and/or warnings are provided in graphic form on an onboard screen (by a colour change), pictograms (symbols), or text.

Help with following the running procedure is provided by a display of the running procedure to be followed and respected on an onboard screen on this vehicle.

Respect of these running instructions is monitored by displaying information and warnings if necessary (in graphic, symbol or text form) on this screen, possibly associated with appropriate sound warnings.

The device is intended particularly for aircraft on the ground moving in an airport, but it is also applicable to any other type of vehicle moving on the ground in airport areas.

BRIEF DESCRIPTION OF DRAWINGS

Other characteristics and advantages of the invention will become clear from the following description of embodiments given as an example with reference to the appended drawings in which.

DETAILED DESCRIPTION OF EMBODIMENTS

Figure 1:
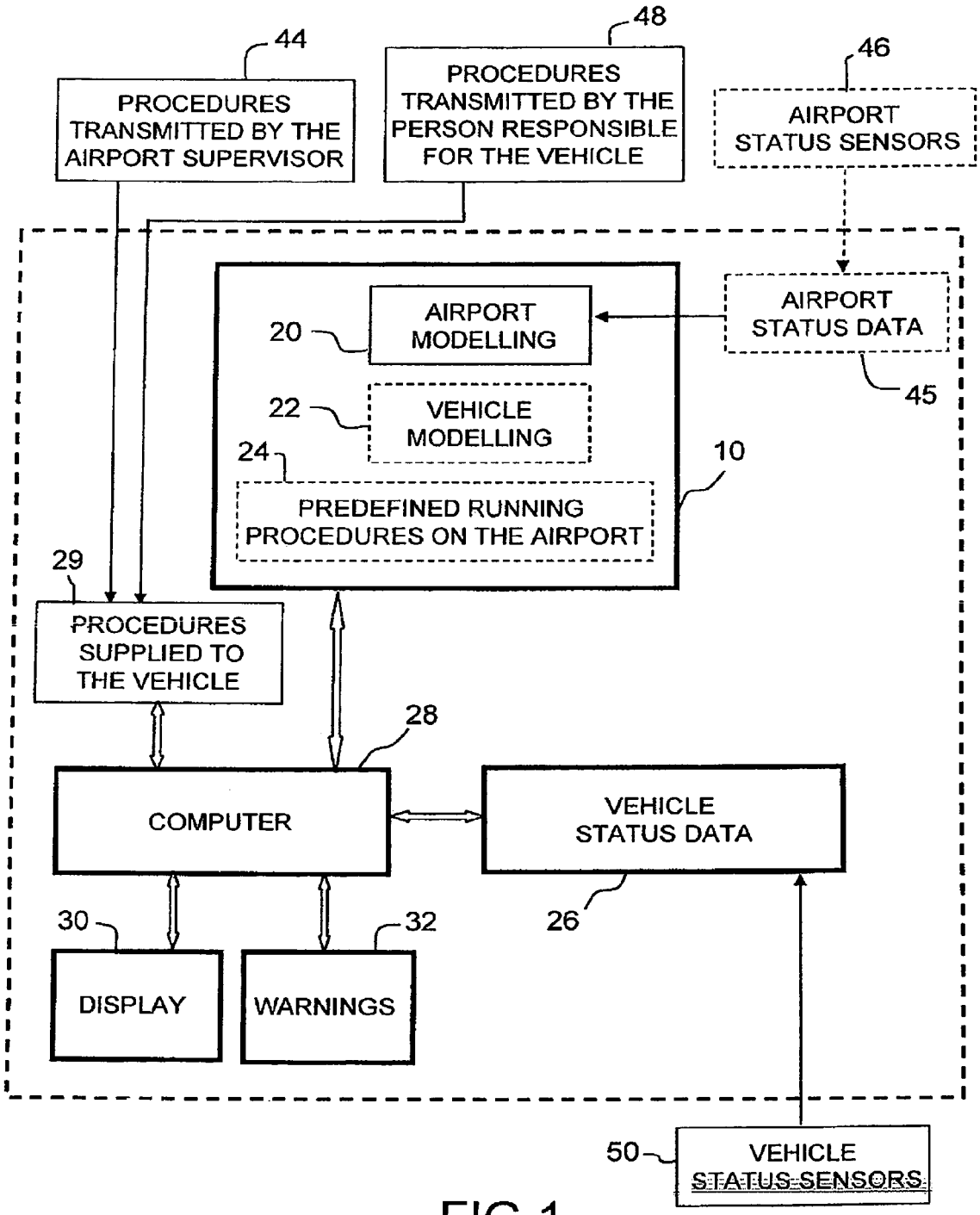
FIG. 1 shows a block diagram of a device for implementation of the running assistance procedure according to the invention.

FIG. 1 shows a block diagram of an onboard device in an aircraft, for use of a running assistance procedure according to the invention.

The device comprises a database 10 with:

a subset 20 of data modelling the airport including topological and/or functional geographic characteristics of airport elements particularly the stand, parking area, runway access ways, runways, taxiways, stop bars possibly with relations between these elements and particularly functional or geographic connectivity links;

a subset 22 of data modelling the aircraft (vehicle) including relevant characteristics such as dimensions, weight, dynamics, etc., of the aircraft;

a subset 24 including predefined procedures applicable to the airport related to running operations.

The device in FIG. 1 according to the invention also comprises:

a vehicle status information acquisition and determination device 26 provided a computer 28 with information particularly about the position of the vehicle and possibly its direction and/or its speed;

a display device 30 displaying information related to the vehicle running procedure;

sound and visual alarm emitters 32.

an acquisition device for acquiring applicable procedures supplied to the vehicle 29 from procedures transmitted by the airport supervisor 44 or the person responsible for the vehicle 48.

This information transmitted by the airport supervisor 44 or the person responsible for the vehicle 48 is received by different means and particularly by radio, computer connections, sensors or man/machine interfaces. For example, information for applicable procedures is obtained by an operator inserting data.

This information can advantageously include information about other vehicles on the airport, for example the nature, position, speed and heading.

Information about the status of the vehicle 26 is perceived by status sensors of the vehicle 50 built into the vehicle or received by external signals used by the method. This information may for example include:

position, speed, heading, turn rate, accelerations of the vehicle;

drive, steering and braking capacity, response time.

The airport modelling subset in the database 10 receives information about the status of the airport 45 perceived by airport status sensors 46 integrated into the vehicle or received by external signals and used in the method according to the invention, to update and/or make airport modelling data 20 more complete. This information may include all modifications to airport characteristics with respect to the database, applicable at each instant, in addition to characteristics contained in the onboard database.

Applicable procedure information is predefined in the database 24.

In a first aspect of the invention, the method and the device according to the invention are intended to monitor that running authorizations are respected, and more specifically that a vehicle does not cross a 'Stop Bar' located on a taxiway protecting the entry to the runway without having received authorisation to enter the runway from airport traffic control.

Monitoring that running authorizations are respected in this aspect of the invention is intended to provide information and/or warnings on the onboard screen, to notify when a transfer point has been crossed, in graphic form (by a colour change) or pictogram form (symbols) or in text form.

Advantageously, the information and/or warnings are provided in advance before crossing.

Monitoring that running authorizations are respected in this aspect of the invention consists of the following steps:

use the database containing a description of different transfer points (typically stop bars) predefined for the airport area, in addition to any other descriptive information about the airport environment. These transfer points are represented by a vector defined by geographic coordinates of the ends of the vector, or the original geographic coordinates and a length (typically equal to at least the width of the taxiway with which this stop bar is associated) and a direction Dr (see FIG. 2) indicating the direction for which crossing of the transfer point is subject to authorization (for example from left to right for a taxiway perpendicular to its centre line in the direction towards the corresponding runway).

determine the position, direction and speed of displacement of the vehicle based on status information of the vehicle detect when a "stop bar" is crossed by calculation means when an aircraft passes from one side of the segment to the other.

Figure 2:
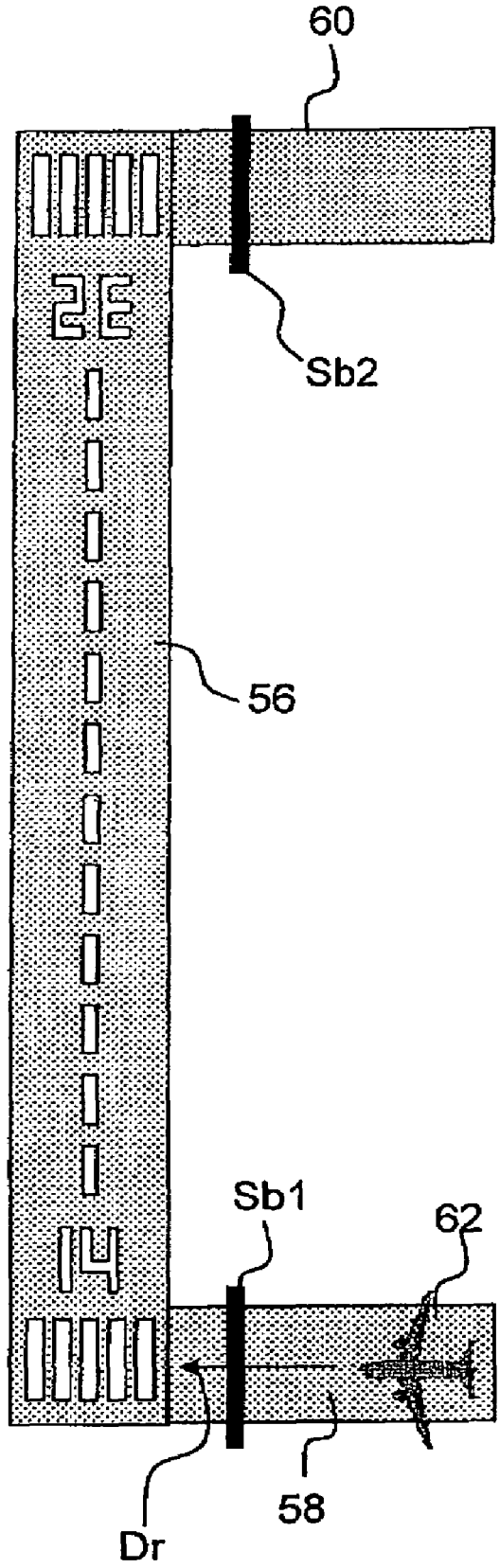
FIG. 2 shows a partial view of an airport including a runway and access ways.

FIG. 2 shows a partial view of an airport including a take off runway 56 and access ways 58, 60 at each end of the runway.

The partial view of the airport in FIG. 2 shows an aircraft 62 running on one of the access ways 58 at one end of the take off runway.

The access ways 58, 60 comprise stop bars Sb1 and Sb2 respectively.

Figure 3A:
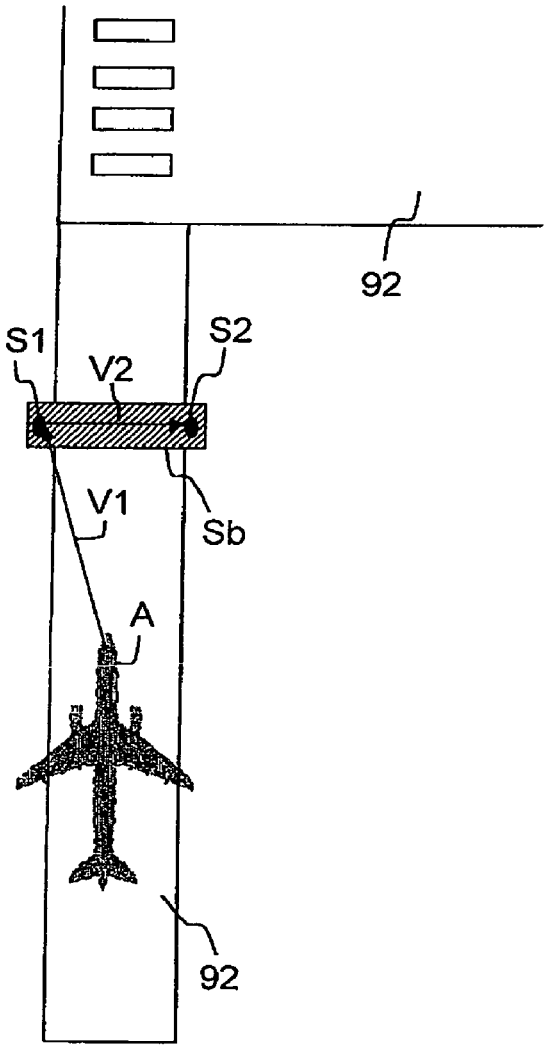
FIGS. 3*a* and 3*b* show the principle of detection of when an aircraft crosses a stop bar.
Figure 3B:
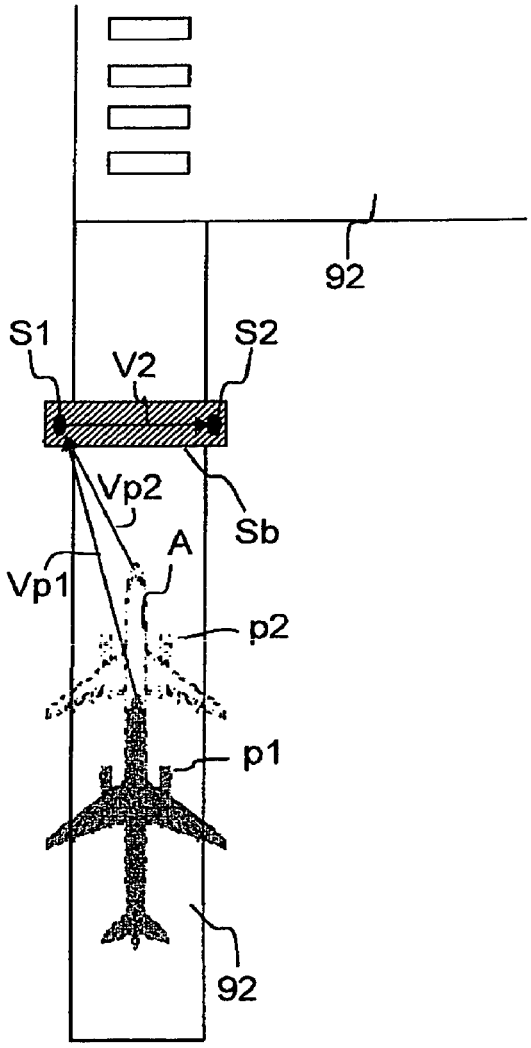

FIGS. 3*a* and 3*b* show the principle of detection according to the invention for when an aircraft crosses a stop bar. FIG. 3*a* shows an aircraft A running on an access way towards a runway 92. The access way comprises a stop bar Sb delimiting an area of this access way to the runway with a crossing authorization.

In this case, the stop bar Sb is modelled by a vector V2 with a start point S1 and an end point S2. The geographic coordinates of the start point S1 and the end point S2 of each stop bar are memorised in the database of the running procedure monitoring assistance device.

The following vectors are considered (see FIG. 3*a*):

A vector V1 with its start point on the aircraft A and end point on the start point S1 of the stop bar Sb, and vector V2 with its start point on the start point S1 of the stop bar and its end at the end point S2 of the stop bar.

The geographic position of the aircraft is determined at any time by device positioning means (for example GPS) and is used by the device computer so as to determine a vector V1.

The computer uses the database including all positions of stop bars to determine the vector V2.

Crossing the stop bar Sb can be determined by a change in a sign of a vector product $Pv=V1_{\wedge}V2$.

The vector product $V1_{\wedge}V2$ is expressed by the following relation:

$$V1_{\wedge}V2=\text{modulus of vector } V1\cdot\text{modulus of vector } V2\cdot\sin\phi\cdot\text{vector } u$$

$\phi$ being the angle formed between the directions of the two vectors V1 and V2

$\phi$ being between 0 and $\pi$

The vector u being a vector perpendicular to the plane formed by the vectors V1 and V2.

sin $\phi$ is equal to 0 when the two vectors V1 and V2 are parallel.

Advantageously, the start point of vector V2 may be any predefined point between S1 and S2 (not including S2).

More simply, in the assistance method according to the invention, crossing of the stop bar is detected by the change in the sign of sin $\phi$, $\phi$ being the angle formed between the directions of the two vectors V1 and V2. According to this principle, the method of detection of the aircraft crossing the stop bar includes the following steps:

determine the geographic position of the aircraft A (or the vehicle) at any time by device positioning means (for example GPS);

determine the direction of vector V1 by calculation;

determine the direction of vector V2 by calculation;

calculate sin $\phi$, where $\phi$ is the angle formed between the directions of the two vectors V1 and V2, $\phi$ being between 0 and $\pi$.

The device according to the invention detects a change in the sign of sin $\phi$ and generates a warning that in this case consists of an immediate display of a text message informing the pilot about which runway is protected by the stop bar that has been crossed.

The pilot is expected to react by stopping the aircraft to verify his authorization (or lack of authorization) to penetrate onto the runway protected by the stop bar.

This warning may possibly be disabled following prior reception of an authorization provided by control (and entered into the system automatically, for example if it has been received by a datalink or by the pilot following a prior instruction, for example received orally or in writing)

Transfer points in routing of an aircraft in the airport may be:

either predetermined in the database in the form of vectors or advantageously created "dynamically" onboard using information from the database as follows:

Identify all stop bars in an airport and their associations with runways or taxiways in a database, with their geographic coordinates, and a description of transfer points in the form of a line segment.

Identify the feared "unauthorized crossing" direction by calculation, by comparing the relative position of all stop bars associated with a single runway with this runway, so as to define the direction of each line segment so that transfer points can be described as vectors.

In a version that improves the running assistance method according to the invention shown in FIG. 3*b*, crossing of a stop bar Sb can be anticipated by calculating the rate of variation Tv of the vector product $V1_{\wedge}V2$ described above to trigger a warning.

FIG. 3*b* shows the aircraft A in a position p1 resulting in a vector Vp1 between the aircraft and the start point S1 of the stop bar, and then in a next position p2 in its displacement towards the stop bar.

in position p1 of the aircraft, the vector product Pv1 is calculated $$Pv1=Vp1_{\wedge}V2$$

in position p2 of the aircraft, the vector product Pv2 is calculated $$Pv2=Vp2_{\wedge}V2$$

The rate of variation Tv of Pv2 with respect to Pv1 is then calculated.

A lower criticality alert can also be generated when the rate of variation Tv of the vector product Pv during displacement of the vehicle results in the stop bar being crossed over within a predefined safety time. For example, this time may be 7 seconds, corresponding to an allowable time equal to the sum of the pilot's reaction time and the aircraft stopping time. Advantageously, this safety time can be determined as a function of the aircraft (or vehicle) speed.

In devices according to the invention, the computer used with the device determines that all airport stop bars are present and then does the calculations considering all these stop bars to determine which stop bar might be crossed.

One version in which the method according to the invention is improved has the advantage that it limits the number of calculations done by the running assistance device, the stop bar(s) towards which the aircraft is running are identified by their presence in an aircraft advance cone with a cone angle θ, typically 15 degrees, in front of the aircraft on each side of its heading and centred on the aircraft. Calculations to determine if a stop bar is crossed are then made considering stop bars identified by this method.

Figure 4:
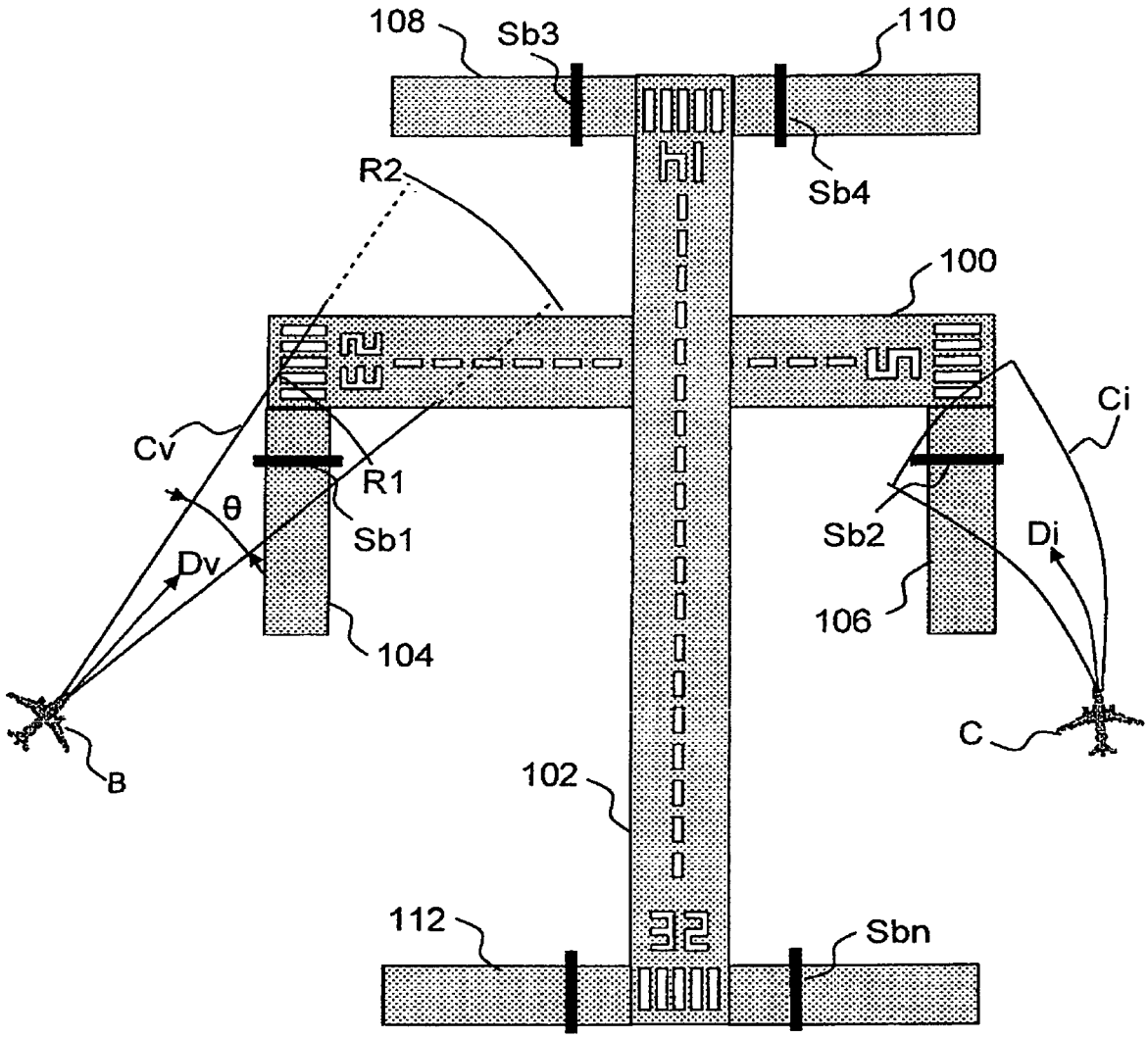
FIG. 4 shows aircraft and their advance cones in an airport.

FIG. 4 shows aircraft and their advance cones in an airport including runways 100, 102 and access ways 104, 106, 108, 110 . . . to runways with corresponding stop bars Sb1, Sb2, Sb3 . . . Sbn.

An aircraft. B moving towards an access way 104 along a direction and at a speed represented by vector Dv.

The stop bar Sb1 towards which the aircraft B is moving is identified by the on board assistance device, in that the stop bar is present in the advance cone Cv, the centre line of the advance cone being colinear with the Dv vector along the direction of displacement of the aircraft B. The device makes predication calculations about crossing the stop bar Sb1

In one embodiment of the method, the advance cone Cv has a cone angle θ equal to 15 degrees and a radius with length R1, for example 100 meters.

To further improve safety in detection of stop bar crossings, the radius of the advance cone Dv is made variable as a function of the aircraft speed. Thus, increasing the aircraft speed will increase the radius R2 of the advance cone so as to increase the range at which furthest stop bars can be detected, for stop bars that can be reached quickly depending on the aircraft speed.

The advance cone may be curved along the direction of the aircraft turn. FIG. 4 shows another aircraft C with an advance cone Ci curved along the movement of the aircraft C making a turn and moving along a curved path represented by the vector Di. In this configuration, the device detects the stop bar Sb2 located in a advance cone Ci curved along the path of the aircraft, to assure reliable prediction of when the aircraft making a turn crosses stop bars.

Beyond monitoring the running authorisations, monitoring that running procedures are respected consists more generally of comparing the behaviour of the vehicle and the procedural characteristics:

limited speed on a segment consistency of the position of the vehicle with the airport element . . .

When a behaviour deviation threshold is crossed, the supervisor is notified by a visual means (colour, text, symbol), intuitively notifying the nature of the failing/deviation and its value.

In this aspect of the invention, the method or the device requires acquisition or modelling of relevant complementary vehicle-related information such as:

dimensions, weight, heading, turn rate, accelerations drive, steering and braking capacity, response times

. . .

Assistance for following running procedures usually consists of displaying the airport in graphic form on a screen at the vehicle control position by means of a processor using the database, and combining the data with information about the status of the airport and the vehicle. The vehicle position is determined relative to the airport map.

The onboard screen display may comprise several modes to present information in the most relevant manner; orientation, scale, selection of displayed elements, . . .

Running procedures are described either:

by a chained list of airport elements making up the chosen path or the path assigned to the vehicle. The chain is not necessarily continuous.

or by a set of points making up the steps or transfer point of the route selected or assigned to the vehicle. Points can be defined geographically independently of elements in the database or connected to elements in the database.

Elements have associated procedural characteristics: start of segment, end of segment, authorisation level or the freedom assigned to the vehicle on each segment, transfer point or point from which a crossing authorisation request is made to the airport supervisor, authorised direction, crossing constraint, etc.

Running procedures can advantageously be displayed on the airport map, using colours, symbols, text information or elements clearly notifying the person responsible for the vehicle about actions to be taken, actions for which authorisation is necessary, and prohibited actions.

Other means for assistance in following the procedure can be used in addition to or instead of the screen, such as head up displays or visual or sound notifications.

Assistance with monitoring consists of providing a graphic transcription (possibly together with or instead of oral information), about progress with running of the vehicle and all deviations between the behaviour of the vehicle and the applicable procedure. For example in the form of an indication of a position error between the vehicle and the procedure.

The invention claimed is:

1. A method to help a person responsible for a vehicle on an airport runway to follow runway running procedures, said method using a device comprising a) a database, comprising:

i) data which model all or some of an airport environment;

ii) data which model characteristics of the vehicle such as the dimensions, weight, mobility characteristics, iii) runway running predefined procedures such as running authorization onto a traffic way, taxiway, parking area, routing, compulsory transfer points;

b) first means for acquiring and determining vehicle status information;

c) second means for acquiring additional procedures supplied by the person responsible for the vehicle or by an airport supervisor;

d) third means for acquiring complementary information relative to said data which model all or some of the airport environment;

e) calculating means;

f) graphically displaying means;

g) sound and visual alarms generating means;

wherein said method comprises at least the following steps:

determining which procedures are applicable to the vehicle, among said additional procedures and said runway running predefined procedures;

continuously calculating deviations between the behaviour of the vehicle and applicable procedures;

graphic displaying progress of the vehicle while running and deviations from applicable procedures;

triggering visual and/or sound alerts in said sound and visual alarm generating means when a predetermined deviation threshold is crossed.

2. The method according to claim 1, wherein said graphically displaying means comprise an onboard screen on which all or some of the elements of the airport environment are displayed making use of data contained in the database and warning information in graphic and/or text form.

3. The method according to claim 1, wherein calculating means enable access to data, update these data when necessary, generate the display of the airport environment to be displayed and determine any information and/or warnings to be displayed.

4. The method of according to claim 1, wherein the status of the vehicle is defined particularly by its position, direction and/or its speed perceived by sensors built into this vehicle or received by external signals and is made available for use.

5. The method according to claim 1, wherein the runway running procedure to be followed and respected is displayed on an onboard screen on this vehicle.

6. The method according to claim 1, wherein respect of the runway running instructions is monitored by displaying information and warnings in graphic, symbol or text form on the onboard screen, possibly associated with appropriate sound warnings.

7. The method according to claim 1, wherein information and/or warnings are provided in advance particularly before a transfer point is crossed.

8. The method according to claim 1, wherein information about the applicable procedures is received by radio.

9. The method according to claim 1, wherein information about applicable procedures is obtained by an operator inserting data.

10. The method according to claim 1, wherein information about applicable procedures is predefined in the database.

11. The method according to claim 1, wherein monitoring that runway running authorizations are respected consists of the following steps:

use the database containing a description of different stop bars Sb predefined for the airport area, in addition to any other descriptive information about the airport environment, these stop bars Sb being represented by a vector defined by the geographic coordinates of the ends of the vector, or the original geographic coordinates and a length, and a direction Dr indicating the direction for which crossing of the stop bar is subject to authorization;

determine the position, direction and speed of displacement of the vehicle based on status information of the vehicle;

detect when a stop bar is crossed by calculation means when an aircraft passes from one side of the segment to the other.

12. The method according to claim 11, wherein the stop bar Sb is modelled by a vector V2 with a start point S1 and an end point S2, the geographic coordinates of the start point S1 and the end point S2 of each stop bar being memorised in the database of the device providing assistance in following runway running procedures.

13. The method according to claim 12, wherein crossing of a stop bar Sb by a vehicle is detected and determined by the change in the sign of the vector product $Pv=V1_{\wedge}V2$, the start point of vector V1 being on the vehicle (A) and its end point on the start point S1 of vector V2.

14. The method according to claim 12, wherein crossing of the stop bar is detected by the change in the sign of $\sin\phi$, $\phi$ being the angle formed between the directions of the two vectors V1 and V2, vector V1 having its start point on the vehicle and its end point on the start point S1 of vector V2.

15. The method according to claim 14, wherein the method of detection of the aircraft crossing the stop bar includes the following steps:

determine the geographic position of the aircraft or the vehicle (A) at any time by device positioning means;

determine the direction of vector V1 by calculation;

determine the direction of vector V2 by calculation;

calculate $\sin\phi$, where $\phi$ is the angle formed between the directions of the two vectors V1 and V2, $\phi$ being between 0 and $\pi$.

detect a change in the sign of $\sin\phi$.

16. The method according to claim 12, wherein the warning for a stop bar being crossed is disabled following prior reception of an authorization provided by control.

17. The method according to claim 15, wherein authorization for crossing a stop bar is entered in the device by the pilot following a prior instruction received orally or in writing.

18. The method according to claim 13, wherein crossing of a stop bar Sb is anticipated by calculating the rate of variation Tv of the vector product $V1_{\wedge}V2$ to trigger a warning.

19. The method according to claim 18, wherein a lower criticality alert is generated when the rate of variation Tv of the vector product Pv results in the stop bar being crossed within a predefined safety time.

20. The method according to claim 19, wherein this safety time may be of the order of 7 seconds, corresponding to an allowable time equal to the sum of the pilot's reaction time and the vehicle stopping time.

21. The method according to claim 19, wherein the safety time is determined as a function of the vehicle speed.

22. The method according to claim 11, wherein the stop bars (Sb, Sb1, Sb2, . . . Sbn) towards which the vehicle (A, B, C) is running are identified by their presence in an aircraft advance cone (Cv, Ci) with a cone angle $\theta$.

23. The method according to claim 22, wherein the advance cone Cv has a cone angle $\theta$ equal to 15 degrees and a radius with length R1, for example 100 meters.

24. The method according to claim 22, wherein the advance cone (Ci) is curved along the direction of the vehicle turn.

25. The method according to claim 1, wherein the onboard screen display may comprise several modes to present information in the most relevant manner; orientation, scale, selection of displayed elements.

26. An onboard device for implementation of the method for providing assistance in following runway running procedures for an airport vehicle according to claim 1, wherein it includes:

a) a database comprising:

i) data which model all or some of an airport environment, ii) data which model characteristics of the vehicle, such as the dimensions, weight, mobility characteristics;

iii) runway running predefined procedures on the airport such as running authorizations onto a traffic way, taxiway, parking area, routing, compulsory transfer points;, b) first means for acquiring and determining vehicle status information;

c) second means for acquiring additional procedures supplied by the person responsible for the vehicle or by an airport supervisor;

d) third means for acquiring complementary information relative to said data which model all or some of the airport environment;

e) calculation means;

f) graphical displaying means of progress of the vehicle while running and deviations from applicable procedures;

g) sound and visual alarms generating means.

27. The onboard device according to claim 26, wherein the device includes a database with:

a subset of data modelling the airport including geographic, topological or functional characteristics of airport elements, and particularly the runway access ways, runways, taxiways, stop bars.

28. The onboard device according to claim 26, wherein the device includes a database with:

a subset of data modelling the aircraft (vehicle) including relevant characteristics such as dimensions, weight, dynamics, etc., of the aircraft.

29. The onboard device according to claim 26, wherein the device includes a database with:

a subset including predefined running procedures applicable to the airport.

* * * * *